US005263219A

United States Patent [19]

Jibiki

[11] Patent Number: 5,263,219

[45] Date of Patent: Nov. 23, 1993

[54] APPARATUS FOR WASHING CURVED GLASS SHEET

[75] Inventor: Satoshi Jibiki, Kanagawa, Japan

[73] Assignee: Nippon Sheet Glass Co., Ltd., Japan

[21] Appl. No.: 27,035

[22] Filed: Mar. 5, 1993

Related U.S. Application Data

[63] Continuation of Ser. No. 919,545, Jul. 24, 1992, abandoned.

[30] Foreign Application Priority Data

Jul. 26, 1991 [JP] Japan ..... 3-210045

[51] Int. Cl.[5] ..... A46B 13/04; B24B 7/24

[52] U.S. Cl. ..... 15/102; 15/77; 15/88.2; 51/33 R; 51/283 R

[58] Field of Search ..... 15/77, 102, 103, 88.2; 51/33 R, 283 R, 284 R

[56] References Cited

U.S. PATENT DOCUMENTS

| | | | |
|---|---|---|---|
| 1,887,554 | 11/1932 | Hitchcock | 15/102 |
| 2,340,933 | 2/1944 | Chilton | 15/77 |
| 2,922,428 | 1/1960 | Wampler et al. . | |
| 2,926,371 | 3/1960 | Swindler | 15/77 |
| 3,999,242 | 12/1976 | Maruyama et al. . | |
| 4,558,480 | 12/1985 | Okafuji et al. | 15/77 |

FOREIGN PATENT DOCUMENTS

| | | |
|---|---|---|
| 1059172 | 6/1959 | Fed. Rep. of Germany . |
| 2452700 | 5/1975 | Fed. Rep. of Germany . |
| 3723694 | 1/1989 | Fed. Rep. of Germany . |
| 310736 | 5/1929 | United Kingdom . |

*Primary Examiner*—Edward L. Roberts

*Attorney, Agent, or Firm*—Merchant, Gould, Smith, Edell, Welter & Schmidt

[57] ABSTRACT

Rotary washing units are supported by a vertically movable and swingable frame in a washing station. Each of the rotary washing units comprises a vertical shaft rotatable by a motor and a washing disk of sponge or brush mounted on the lower end of the shaft for contact with a curved glass sheet introduced into the washing station. The shafts of the rotary washing units are arranged in an array extending perpendicularly to the direction in which the curved glass sheet is fed through the washing station. The shafts are normally urged by respective springs to move downwardly to enable the washing disks to follow the configuration of largely curved glass sheets. The downward movement of the shafts is limited by stoppers. Rotative power from a motor is transmitted successively to the rotary washing units by a belt trained around pulleys on the respective shafts. The shafts are hollow to supply a washing solution therethrough to the surface of the curved glass sheet being washed, so that the washing solution can be supplied to the glass sheet fully over its entire surface area even though the glass sheet is curved.

6 Claims, 12 Drawing Sheets

APPARATUS FOR WASHING CURVED GLASS SHEET

This is a continuation of application Ser. No. 07/919,545, filed Jul. 24, 1992, abandoned.

BACKGROUND OF THE INVENTION

1. Field of the Invention

The present invention relates to an apparatus for automatically washing a curved sheet of glass.

2. Description of the Prior Art

One known glass sheet washing apparatus is disclosed in Japanese laid-open utility model publication No. 2-1290. The disclosed glass sheet washing apparatus comprises a staggered array of vertically movable and rotatable washing disks arranged perpendicularly to the direction in which a glass sheet is horizontally fed by a conveyor. Each of the washing disks is made of sponge that is elastically deformable in conformity with different glass shapes. In the case where a glass sheet to be washed is of a largely curved configuration such as for use as an automobile windshield, however, the conventional washing disks cannot be elastically deformed sufficiently enough to follow the surface curvature of the curved glass sheet. If the washing disks were used to wash the largely curved glass sheet, then they would impose undue stresses on the glass sheet, tending to crack or break the glass sheet while washing the glass sheet.

SUMMARY OF THE INVENTION

It is an object of the present invention to provide an apparatus for automatically washing curved sheet glass without exerting undue stresses thereto.

According to the present invention, there is provided an apparatus for washing a curved glass sheet, comprising a washing station for washing a curved glass sheet, a loading station having conveying means for feeding a curved glass sheet in a direction toward the washing station, and an unloading station having conveying means for feeding a curved glass sheet from the washing station, the washing station being disposed between the loading and unloading stations. The washing station comprises a frame vertically movable and swingable about a horizontal axis extending perpendicularly to the direction, an introducing and discharging mechanism supported by the frame for introducing the curved glass sheet from the loading station into the washing station, and discharging the curved glass sheet from the washing station to the unloading station, a bearing roll supported by the frame for supporting a lower surface of the curved glass sheet which has moved through the introducing and discharging mechanism, and an array of rotary washing units supported by the frame for washing the curved glass sheet while the lower surface thereof is being supported by the bearing roll, the array of rotary washing units being disposed above the bearing roll and extending substantially perpendicularly to the direction.

The frame is swung through an angle corresponding to the angle of the leading end of the curved glass sheet which is about to move from the loading station into the washing station. Then, the introducing and discharging mechanism introduces the curved glass sheet into the washing station. In the washing station, the curved glass sheet is washed by the rotary washing units while the frame swings back.

The rotary washing units are vertically movable independently of each other so that they can wash curved glass sheets of complex shapes.

The rotary washing units are noncircular in shape when viewed in plan, and adjacent ones of the rotary washing units are positioned with respect to each other for rotation along overlapping paths. Particularly, the rotary washing units are of a three-lobed shape when viewed in plan, and adjacent ones of the rotary washing units are held in mesh with each other.

Each of the rotary washing units comprises a hollow shaft for supplying a washing solution therethrough, the hollow shaft being rotatably supported on the frame, and a washing disk mounted on the hollow shaft for contact with the curved glass sheet. Since the washing solution is supplied through the shafts of the rotary washing units, the washing solution can reach the entire surface area of the glass sheet even if the glass sheet is largely curved.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 1:
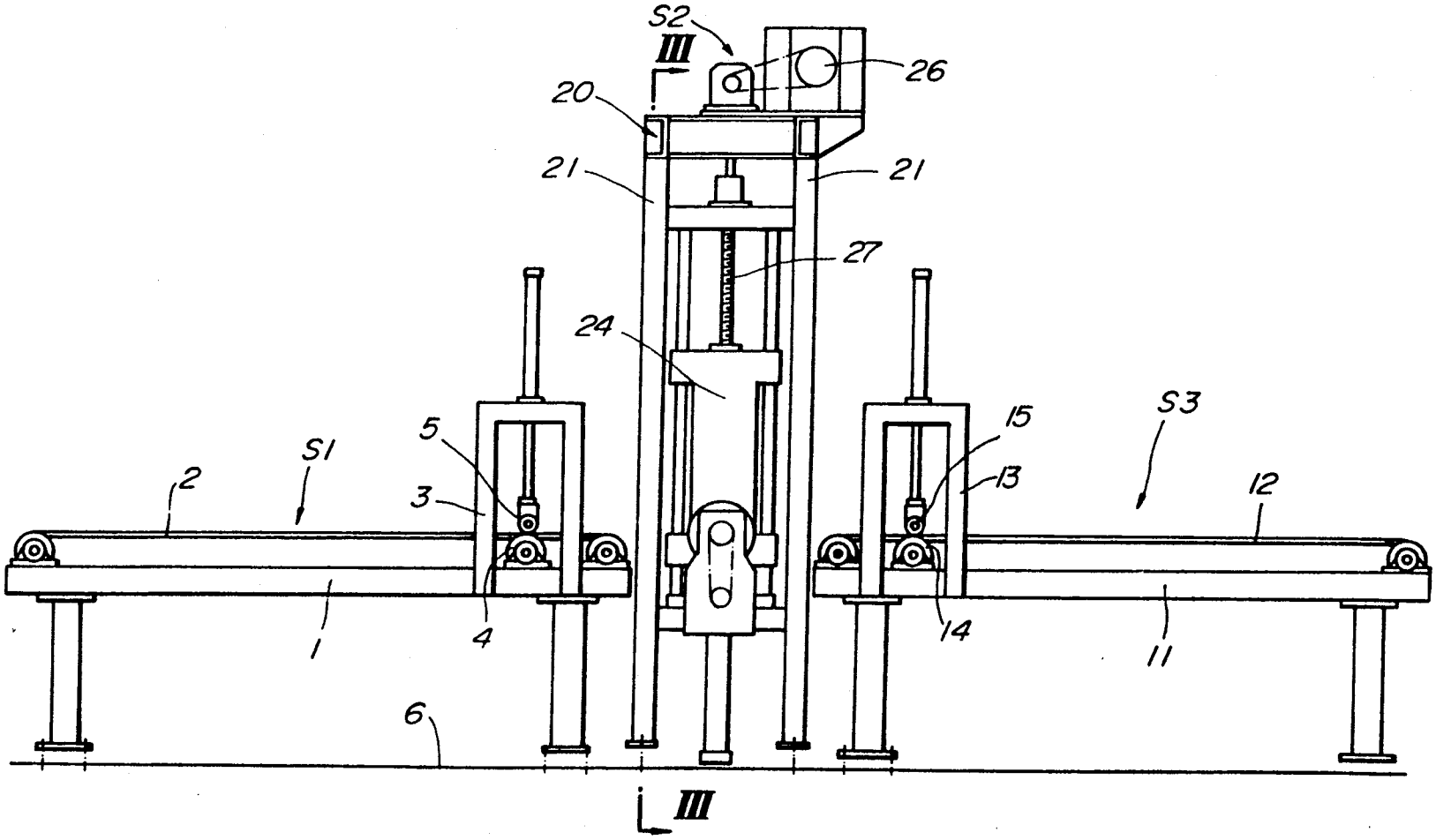
FIG. 1 is a front elevational view of an apparatus for washing a curved glass sheet according to the present invention.
Figure 2:
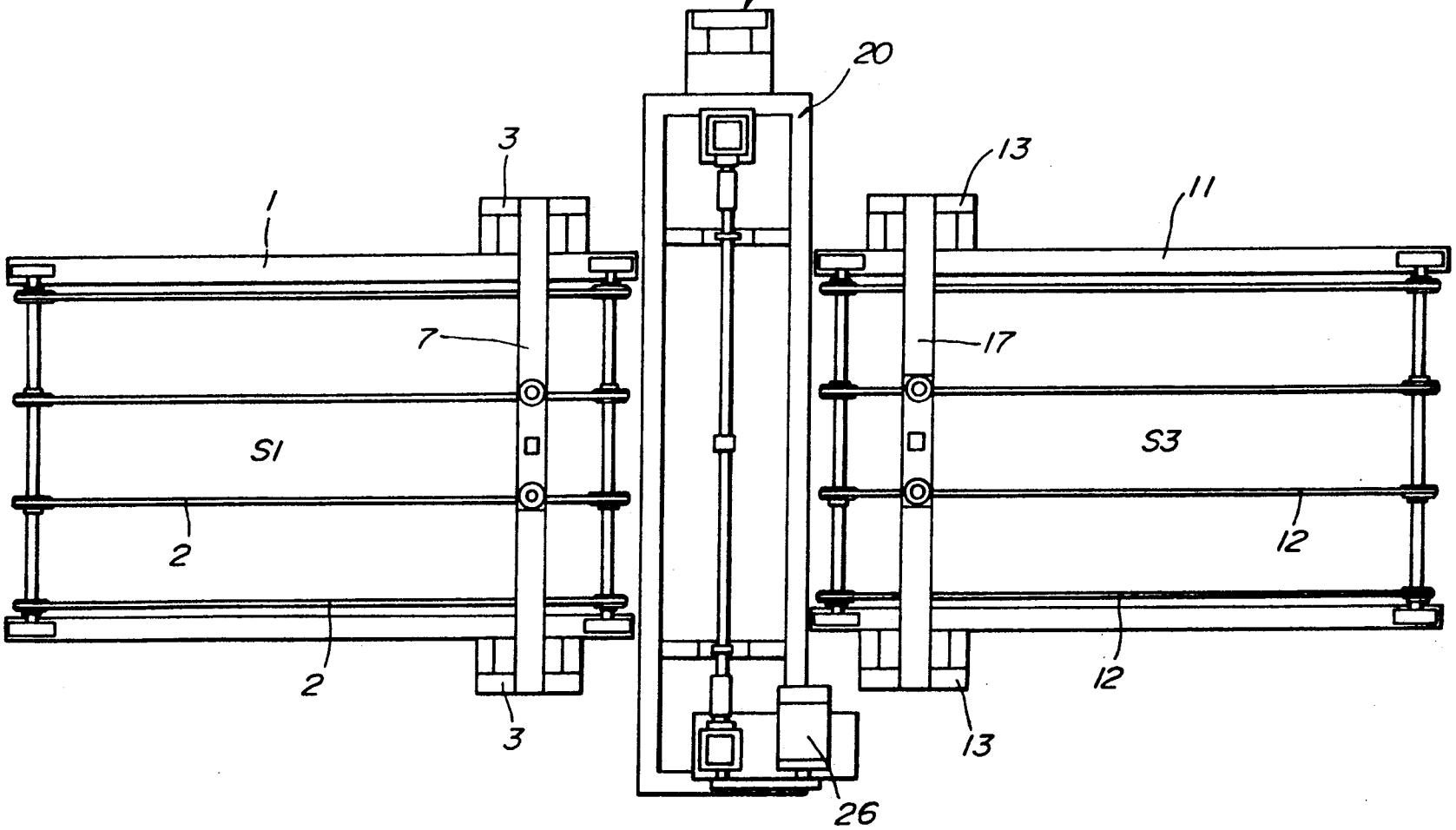
FIG. 2 is a plan view of the apparatus.
Figure 3:
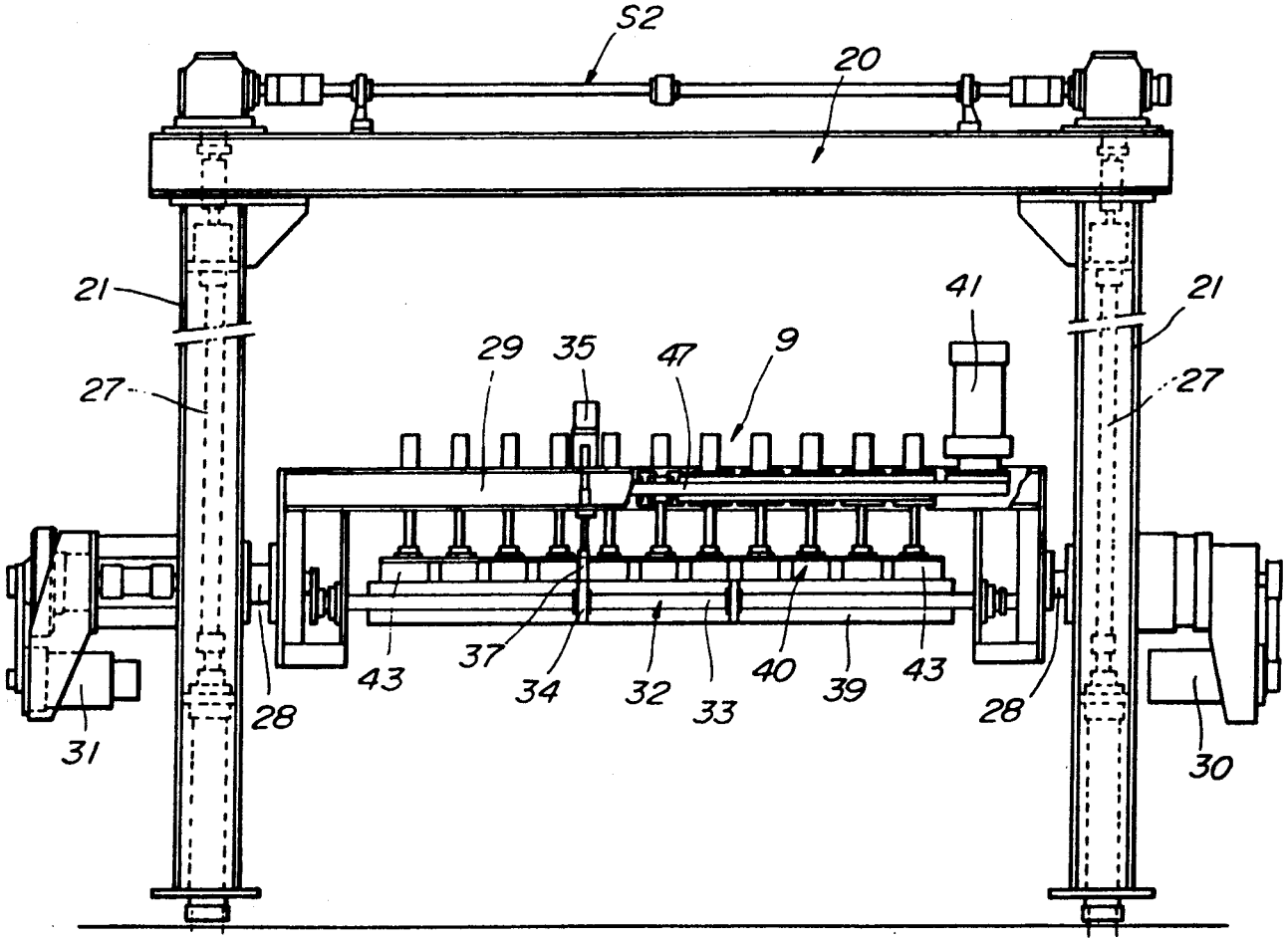
FIG. 3 is a fragmentary cross-sectional view taken along line III—III of FIG. 1.

As shown in FIGS. 1 through 3, an apparatus for washing a curved glass sheet according to the present invention generally comprises a loading station S1, an unloading station S3, and a washing station S2 disposed between the loading and unloading stations S1, S3.

The loading station S1 comprises a plurality of laterally spaced conveyor belts 2 mounted on a support base 1 disposed on a floor 6. The loading station S1 has a pair of vertical support columns 3 mounted on respective lateral sides of the support base 1 at an end thereof adjacent to the washing station S2. The support columns 3 are joined by a transverse beam 7 disposed above and extending transversely of the conveyor belts 2. The beam 7 supports a plurality of presser rolls 5 disposed immediately above respective bearing rolls 4 that are mounted on the support base 1. The presser rolls 5 are held against the upper surface of a curved glass sheet that is supported on the bearing rolls 4 while the curved glass sheet is fed by the conveyor belts 2.

Similarly, the unloading station S3 comprises a plurality of laterally spaced conveyor belts 12 mounted on a support base 11 disposed on the floor 6. The loading station S3 has a pair of vertical support columns 13 mounted on respective lateral sides of the support base 11 at an end thereof adjacent to the washing station S2. The support columns 13 are joined by a transverse beam 17 disposed above and extending transversely of the conveyor belts 12. The beam 17 supports a plurality of presser rolls 15 disposed immediately above respective bearing rolls 14 that are mounted on the support base 11. The presser rolls 15 are held against the upper surface of a curved glass sheet that is supported on the bearing rolls 14 while the curved glass sheet is fed by the conveyor belts 12.

Figure 4:
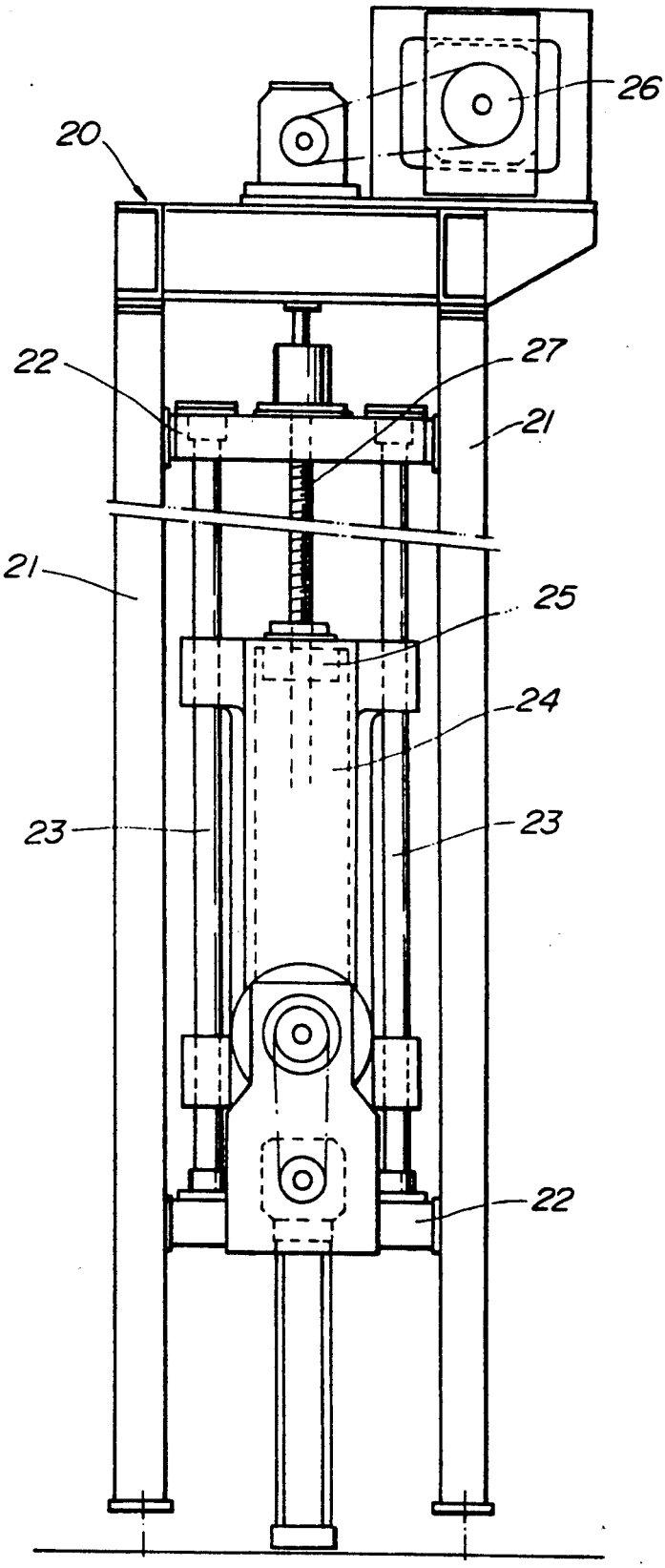
FIG. 4 is an enlarged fragmentary front elevational view of a washing station of the apparatus.

The washing station S2 comprises a portal-shaped frame 20 vertically mounted on the floor 6. The portal-shaped frame 20 comprises a pair of laterally spaced vertical support column assemblies each composed of a pair of horizontally spaced support columns 21. As shown in FIG. 4, in each of the vertical support column assemblies, a pair of vertically spaced horizontal cross members 22 is disposed between and joined to the support columns 21. A pair of vertical guide rods 23 extends between and is coupled to the cross members 22. The guide rods 23 support thereon a vertically movable carriage 24 having a nut 25 threaded over a vertical screw shaft 27 supported on the cross members 22 and positioned between the guide rods 23. The screw shaft 27 has an upper end operatively coupled to a motor 26 mounted on the top of the frame 20, so that the screw shaft 27 can be rotated about its own axis by the motor 26. Therefore, when the motor 26 is energized, the carriage 24 is vertically moved along the guide rods 23 by the screw shaft 27.

The carriages 24 in the respective vertical support column assemblies are spaced from each other perpendicularly to the direction in which a curved glass sheet is fed from the loading station S1 through the washing station S2 to the unloading station S3. As shown in FIG. 3, a horizontally extending frame 29 extends between and is supported on the carriages 24 through respective horizontal shafts 28. One of the carriages 24 supports thereon a motor 30 which is operatively coupled to one of the horizontal shafts 28 to angularly move the frame 29. The other carriage 24 supports thereon a motor 31 for actuating an introducing and discharging mechanism 32 supported by and positioned in the frame 29.

Figure 5:
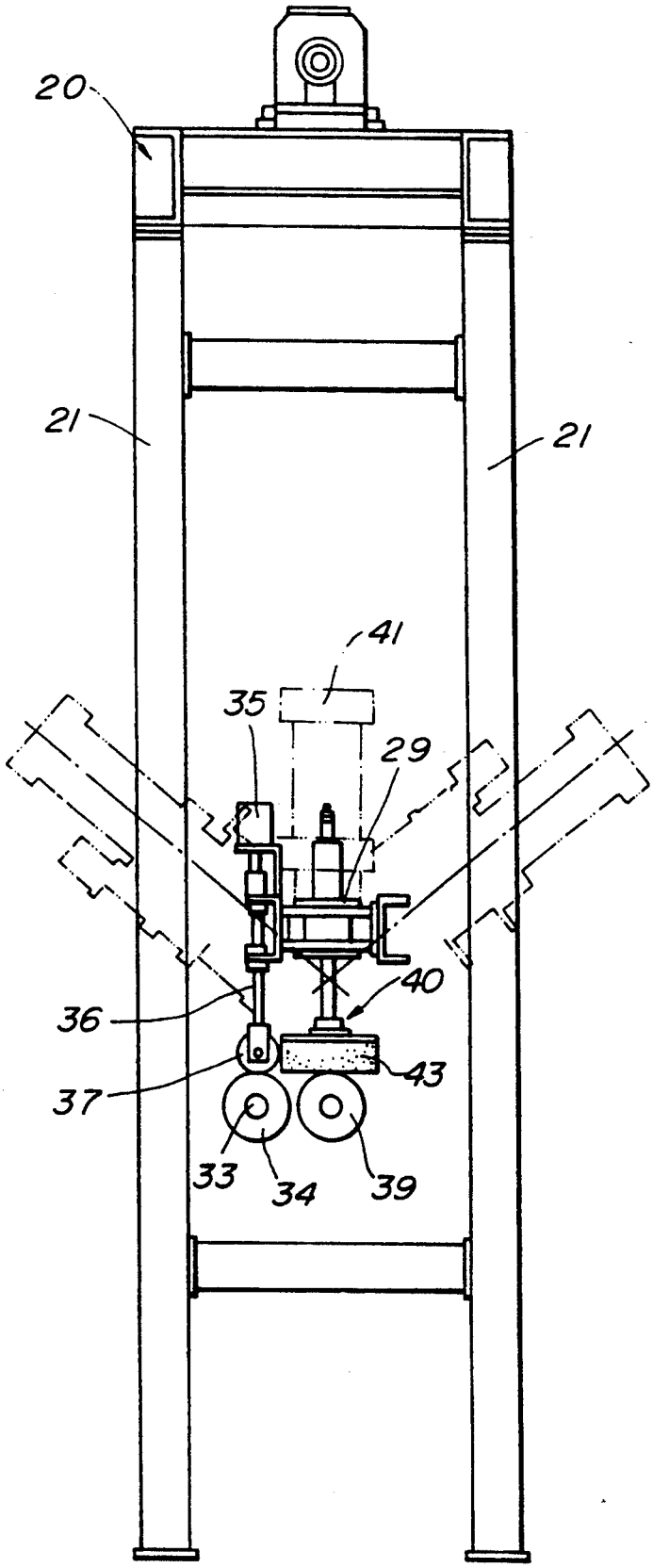
FIG. 5 is a front elevational view showing the manner in which a frame of the washing station angularly moves.

As shown in FIGS. 3 and 5, the introducing and discharging mechanism 32 comprises a horizontal shaft 33 extending between ends of the frame 29 and rotatable about its own axis by the motor 31, a plurality of horizontally spaced rollers 34 fitted over the shaft 33 for rotation therewith, a plurality of vertically movable rods 36 supported on the frame 29 in alignment with the respective rollers 34 and vertically movable by respective cylinders 35 mounted on the frame 29, and a plurality of rollers 37 rotatably mounted on the respective lower ends of the rods 36 for contact with the respective rollers 34. A curved sheet of glass fed from the loading station S1 is sandwiched between the rollers 34, 37, and introduced into the washing station S2 when the rollers 34 are rotated by the motor 31. After having been washed in the washing station S2, the curved sheet of glass is discharged into the unloading station S3 as the rollers 34 are rotated by the motor 31.

The frame 29 also supports a horizontal bearing roll 39 disposed downstream of the introducing and discharging mechanism 32 with respect to the direction in which the curved glass sheet is fed through the washing station S2. The horizontal bearing roll 39 serves to bear the lower surface of the curved glass sheet as it has passed the introducing and discharging mechanism 32. The washing station S3 comprises an array of interlinked rotary washing units 40 disposed above and arranged along the horizontal bearing roll 39.

Figure 6:
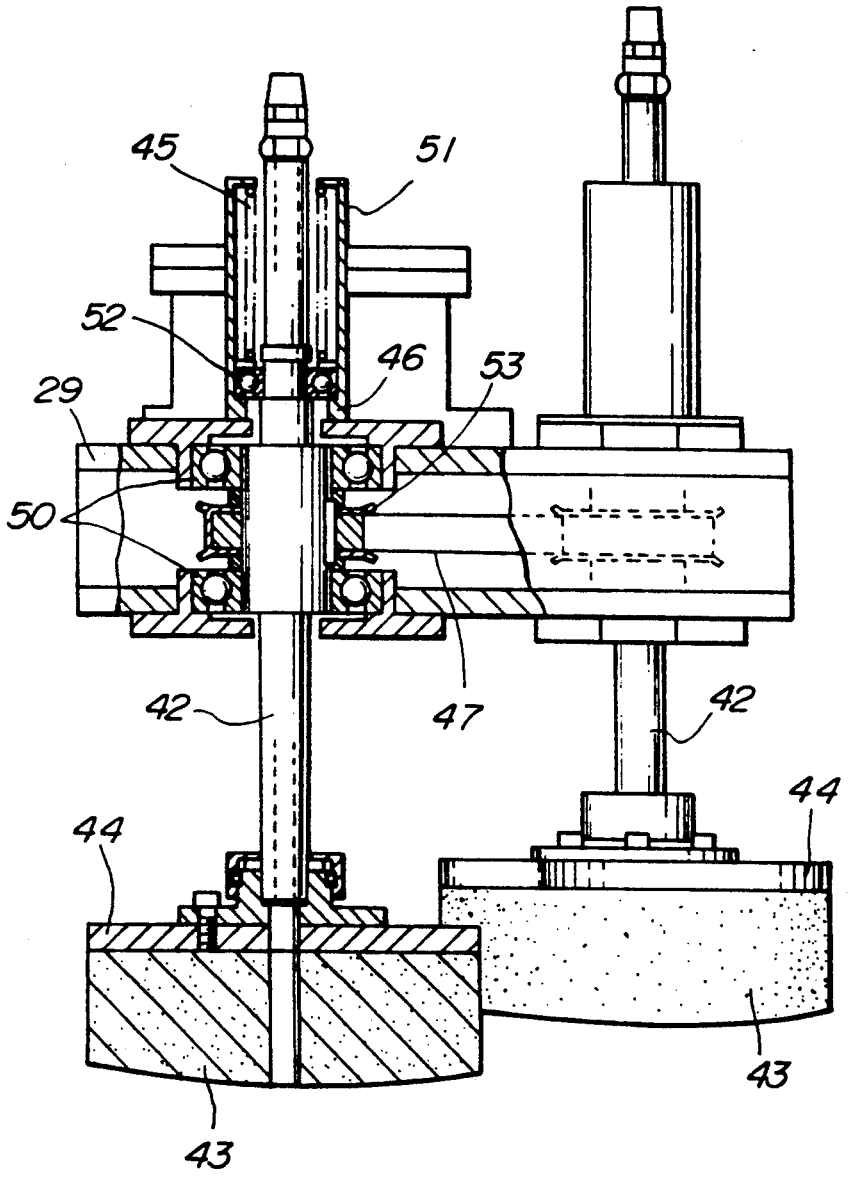
FIG. 6 is an enlarged cross-sectional view of a rotary washing unit.
Figure 7:
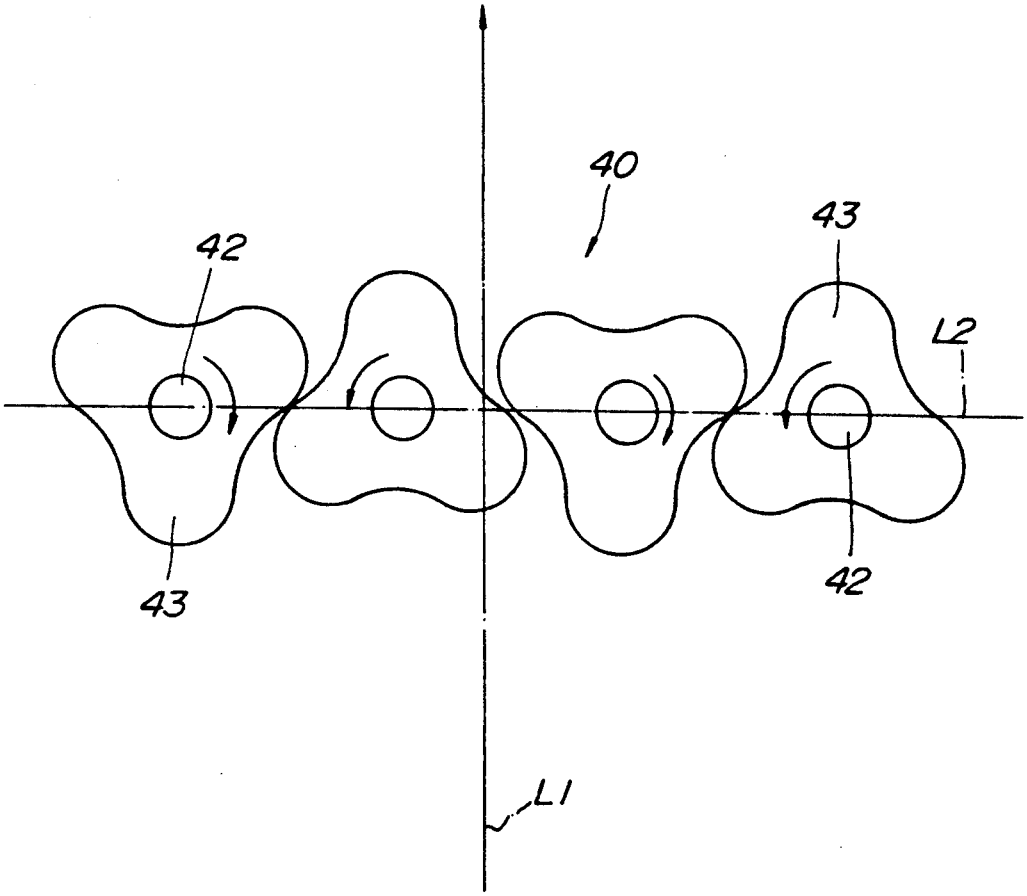
FIG. 7 is a plan view of an array of rotary washing units.

As shown in FIG. 6, each of the rotary washing units 40 comprises a vertical shaft 42 extending through the frame 29 and rotatable by a motor 41 mounted on the frame 29 at one end thereof, and a washing disk 43 of sponge or brush attached to the lower end of the shaft 42 through an attachment plate 44. The shaft 42 is rotatably supported on the frame 29 by bearings 50. The washing disk 43 will be elastically held in contact with the upper surface of the curved glass sheet that is introduced into the washing station S2. As shown in FIG. 7, the shafts 42 of the rotary washing units 40 are arrayed substantially along a direction L2 normal to the direction L1 in which the curved glass sheet is fed through the washing station S2.

FIG. 6, each of the shafts 42 is normally urged to move downwardly by a spring 45 for thereby enabling the washing disk 43 to be held neatly against the upper surface of a glass sheet which is largely curved. The spring 45 acts between the upper end of a sleeve 51 on the frame 29 and a bearing 52.. fixed to the shaft 42. The downward movement of the shaft 42 under the bias of the spring 45 is limited by a stopper 46.

The rotative power of the motor 41 is transmitted successively to the shafts 42 by a belt 47 which is trained successively around pulleys 53 mounted on the respective shafts 42 between the bearings 50. More specifically, the belt 47, is in the form of an endless toothed belt having one stretch trained alternately in opposite directions around adjacent pulleys 53 and the other stretch going straight back to the motor 41, so that the rotary washing units 40 will rotate alternately in opposite directions, as shown in FIG. 7. The washing disk 43 and the attachment plate 44 in each of the rotary washing units 40 are noncircular in shape when viewed in plan, specifically of a triple-lobed shape when viewed in plan. Adjacent ones of the rotary washing units 40 are positioned with respect to each other such that they neatly mesh with each other so as to rotate about the respective shafts 42 along overlapping paths. Since the rotary washing units 40 rotate along overlapping paths, they can wash the upper surface of a curved glass sheet over its entire area while the curved glass sheet is moving through the washing station S2. In addition, the array of rotary washing units 40 may be of a relatively small length, permitting the washing apparatus to be reduced in width.

The shafts 42 of the rotary washing units 40 are hollow for supplying therethrough a washing solution to the upper surface of a curved glass sheet in the washing station S2. Consequently, the washing solution can be supplied to the glass sheet surface fully over its entire surface even if the glass sheet is largely curved.

A process of washing a curved glass sheet with the washing apparatus according to the present invention will be described with reference to FIGS. 8 through 12.

Figure 8:
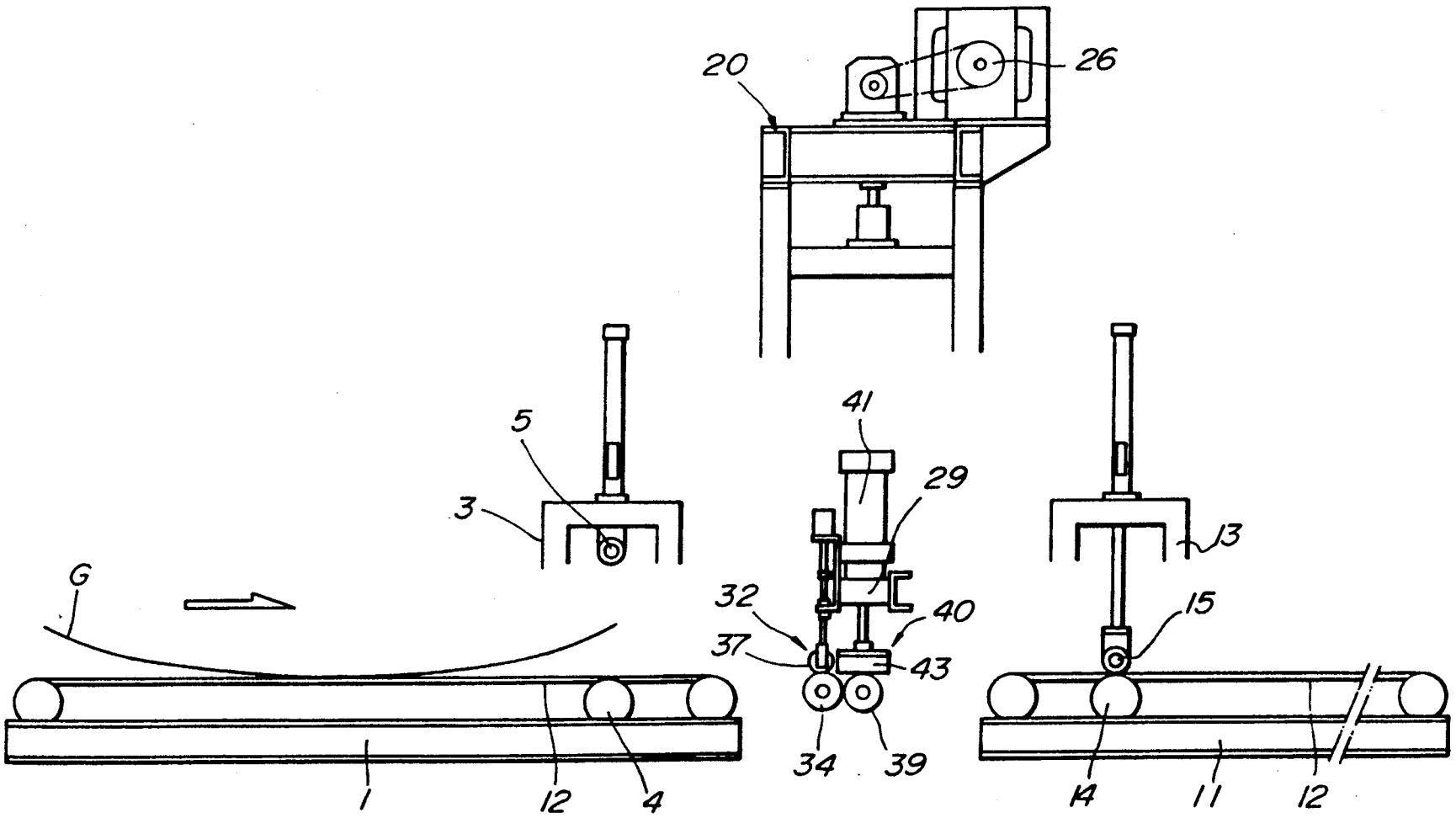
FIGS. 8 through 12 are schematic front elevational views showing the manner in which the apparatus operates.

As shown in FIG. 8, a curved glass sheet G is horizontally fed by the conveyor belts 2 of the loading station S1. At this time, the presser rolls 5 are in an elevated position upwardly away from the bearing rolls 4, and the frame 29 in the washing station S2 is vertically oriented.

Figure 9:
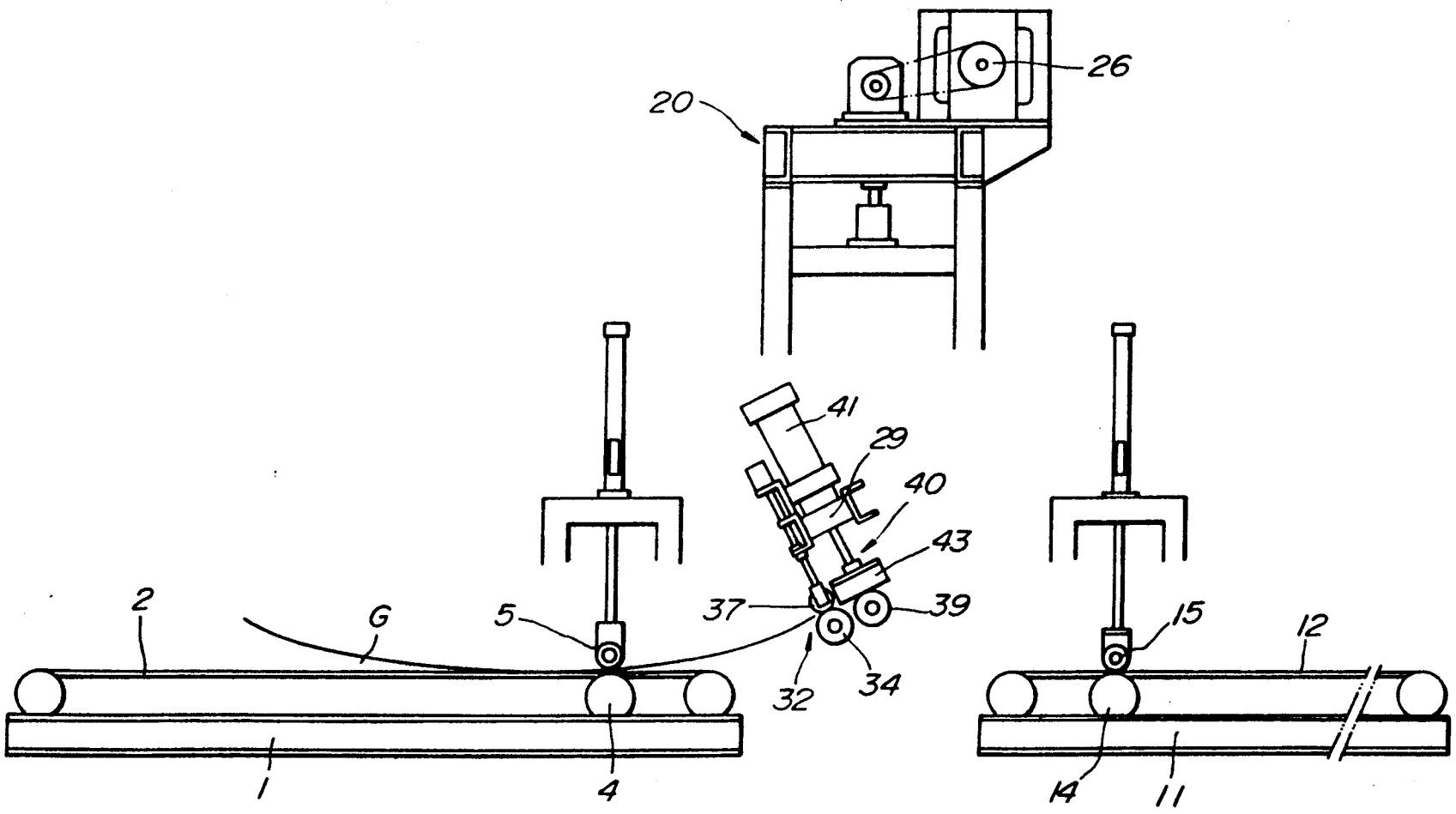

As the curved glass sheet G is horizontally fed toward the washing station S2 by the conveyor belts 2, the frame 29 is lifted by the motor 26, and at the same time is angularly moved or swung by the motor 30 in such a direction that its upper end is shifted toward the loading station S1 and its lower end toward the unloading station S3, as shown in FIG. 9, through angle corresponding to the angle of the leading end of the curved glass sheet G. The leading end of the curved glass sheet G is now caught between the rollers 34, 47 of the introducing and discharging mechanism 32. The motor 31 is energized to introduce the curved glass sheet G into the washing station S2.

Figure 10:
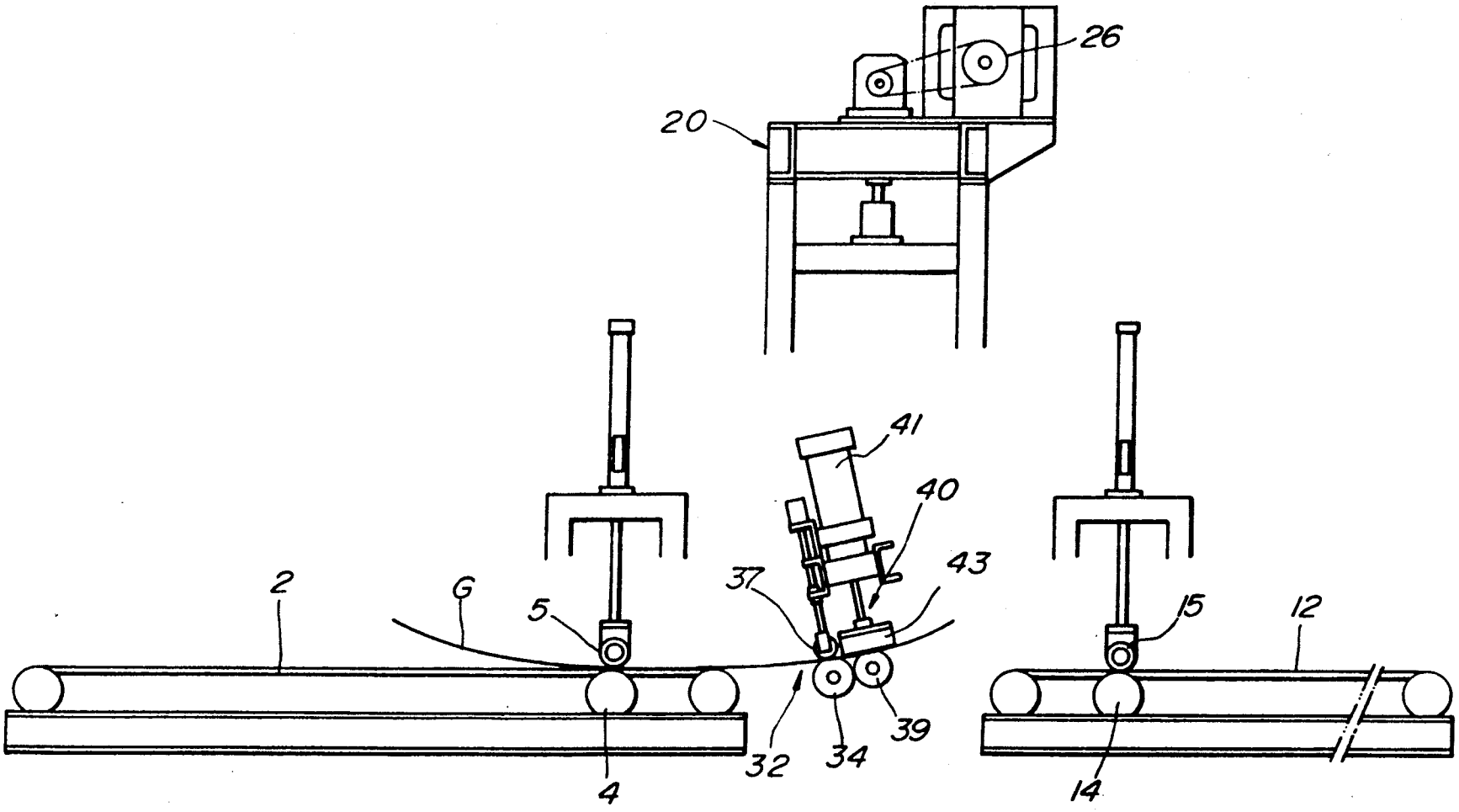
Figure 11:
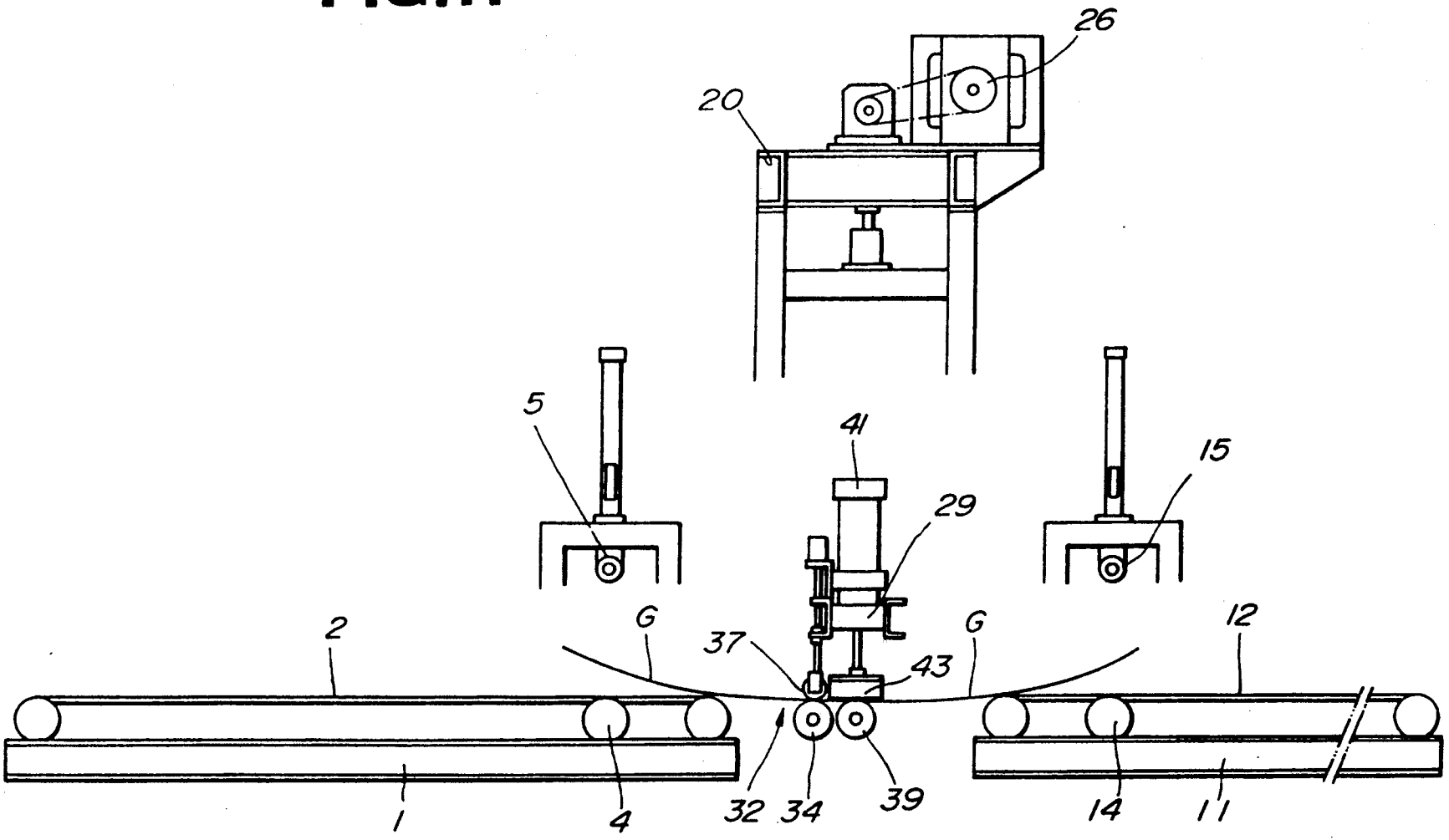

The rotation of the rollers 34, 37 moves the curved glass sheet G between the bearing roll 39 and the rotary washing units 43, as shown in FIG. 10. The upper surface of the curved glass sheet G is washed as the washing solution is supplied thereto through the shafts 42 while the rotary washing units 43 are rotating. Since the curved glass sheet G is washed while at the same time it is being fed through the washing station S2, the frame 29 is swung to follow the curved configuration of the curved glass sheet G so as not to impose undue stresses to the curved glass sheet G. When an intermediate area of the curved glass sheet G in the direction in which it is fed is washed, the frame 29 is swung back to its vertically oriented position in order to hold the glass sheet G horizontally, as shown in FIG. 11.

Figure 12:
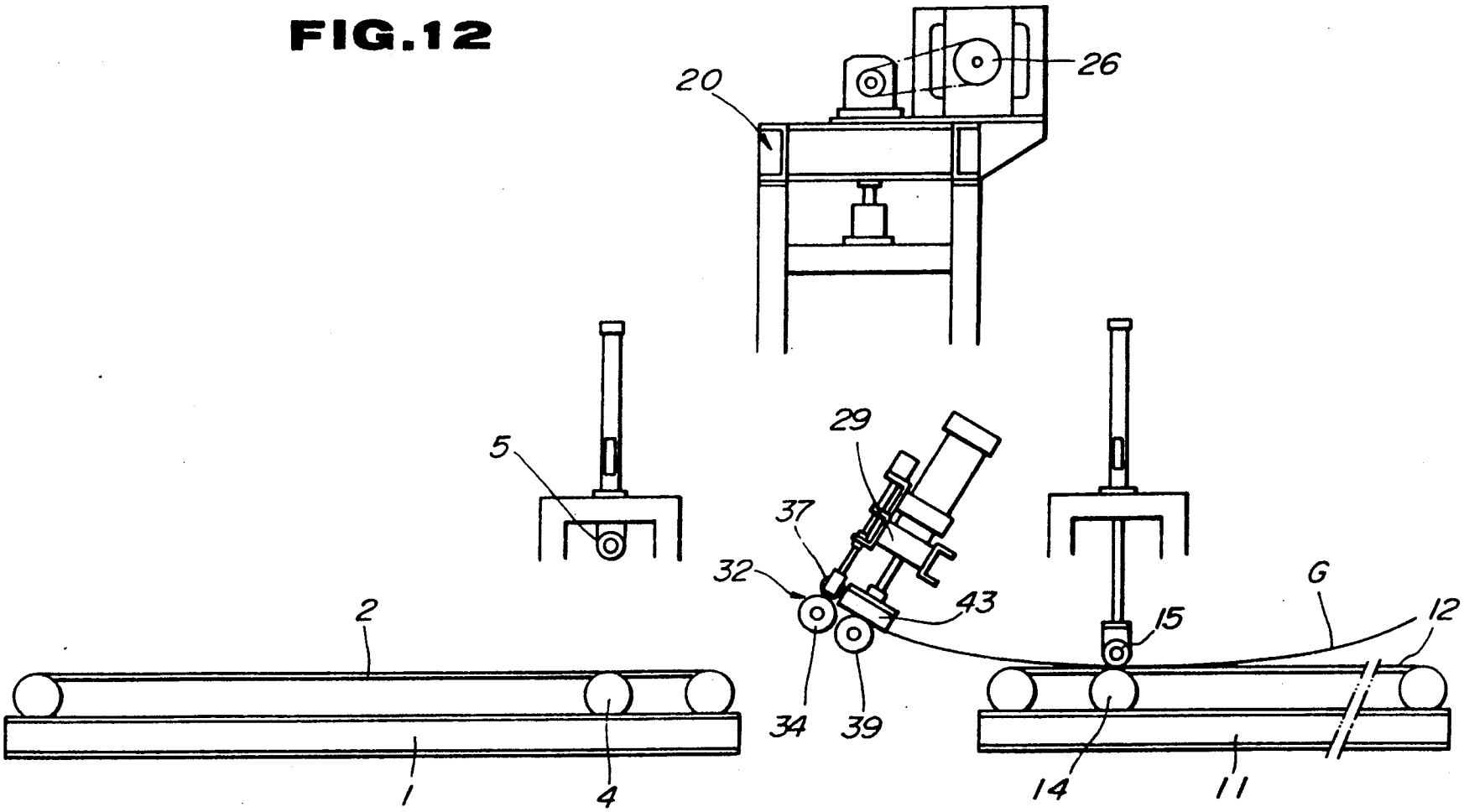

Thereafter, as shown in FIG. 12, as the glass sheet G is washed toward its trailing end, the frame 29 is angularly moved by the motor 30 in such a direction that its upper end is shifted toward the unloading station S3 and its lower end toward the loading station S1. The glass sheet G as it leaves the washing station S2 is therefore delivered onto the conveyor belts 12 of the unloading station S3 while being held horizontally.

Since the rotary washing units 40 are supported by the frame 29 that is vertically movable and swingable about a horizontal axis which extends perpendicularly to the direction in which the curved glass sheet G is fed, the rotary washing units 40 can wash the curved glass sheet G while following the curved shape thereof. Therefore, the rotary washing units 40 neither impose unduly excessive stresses on the curved glass sheet G nor force the curved glass sheet G into undesired postures. The curved glass sheet G is thus prevented from being cracked or broken while being washed, and can be washed efficiently.

The rotary washing units 40 can wash curved glass sheets of complex shapes because the rotary washing units 40 are vertically movable independently of each other.

The rotary washing units 40 are noncircular in shape when viewed in plan, and adjacent ones of the rotary washing units 40 are positioned with respect to each other such that they neatly mesh with each other so as to rotate along overlapping paths. Consequently, the rotary washing units 40 can wash the upper surface of a curved glass sheet over its entire area, and the array of rotary washing units 40 may be of a relatively small length, resulting in a reduced apparatus width.

The washing solution is supplied to the curved glass sheet being washed through the shafts 42 of the rotary washing units 40. Accordingly, the washing solution can be supplied in a sufficient quantity between the rotary washing units 40 and the curved glass sheet irrespective of the curved configuration of the glass sheet.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

What is claimed is:

1. An apparatus for washing a curved glass sheet, comprising:
   - a washing station for washing a curved glass sheet;
   - a loading station having conveying means for feeding a curved glass sheet in a direction toward said washing station; and
   - an unloading station having conveying means for feeding a curved glass sheet from said washing station;
   - said washing station being disposed between said loading and unloading stations;
   - said washing station comprising:
     - a frame vertically movable and swingable about a horizontal axis extending perpendicularly to said direction;
     - an introducing and discharging mechanism supported by said frame for introducing the curved glass sheet from said loading station into said washing station, and discharging the curved glass sheet from said washing station to said unloading station;
     - a bearing roll supported by said frame for supporting a lower surface of the curved glass sheet which has moved through said introducing and discharging mechanism; and
     - an array of rotary washing units supported by said frame for washing the curved glass sheet while the lower surface thereof is being supported by said bearing roll, said array of rotary washing units being disposed above said bearing roll and ext ending substantially perpendicularly to said direction.

2. An apparatus according to claim 1, wherein said rotary washing units are vertically movable independently of each other.

3. An apparatus according to claim 1, wherein said rotary washing units are noncircular in shape when viewed in plan, and adjacent ones of said rotary washing units are positioned with respect to each other for rotation along overlapping paths.

4. An apparatus according to claim 3, wherein said rotary washing units are of a three-lobed shape when viewed in plan, and adjacent ones of said rotary washing units are held in mesh with each other.

5. An apparatus according to claim 1, wherein each of said rotary washing units comprises a hollow shaft for supplying a washing solution therethrough, said hollow shaft being rotatably supported on said frame, and a washing disk mounted on said hollow shaft for contact with the curved glass sheet.

6. An apparatus according to claim 1, wherein said introducing and discharging mechanism comprises a plurality of first rollers rotatably supported by said frame, a plurality of second rollers rotatably supported by said frame in vertical alignment with said first rollers, respectively, and an actuator for rotating said first rollers to move the curved glass sheet between said first and second rollers, said first and second rollers being positioned upstream of said rotary washing units with respect to said direction.

* * * * *